US007140650B2

(12) United States Patent
Berg

(10) Patent No.: US 7,140,650 B2
(45) Date of Patent: Nov. 28, 2006

(54) SLIDE LATCH

(75) Inventor: Gert Berg, Gloustershire (GB)

(73) Assignee: Southco, Inc., Concordville, PA (US)

( * ) Notice: Subject to any disclaimer, the term of this patent is extended or adjusted under 35 U.S.C. 154(b) by 67 days.

(21) Appl. No.: 11/162,786

(22) Filed: Sep. 22, 2005

(65) Prior Publication Data

US 2006/0006665 A1 Jan. 12, 2006

Related U.S. Application Data

(63) Continuation of application No. 09/619,510, filed on Jul. 19, 2000, now abandoned.

(60) Provisional application No. 60/144,801, filed on Jul. 21, 1999.

(51) Int. Cl.
*E05C 5/00* (2006.01)

(52) U.S. Cl. ..... 292/67; 292/5; 292/63; 292/163; 292/175; 292/337; 292/DIG. 11; 292/DIG. 30; 292/DIG. 51; 292/DIG. 63

(58) Field of Classification Search ..... 292/5, 292/32, 42, 163, 175, 337, DIG. 11, DIG. 30, 292/DIG. 38, DIG. 61, DIG. 51, DIG. 55, 292/DIG. 63, 63–69
See application file for complete search history.

(56) References Cited

U.S. PATENT DOCUMENTS

| | | | | | |
|---|---|---|---|---|---|
| 1,675,591 | A | * | 7/1928 | Bell | 292/175 |
| 1,895,892 | A | * | 1/1933 | Moore | 292/164 |
| 2,746,784 | A | * | 5/1956 | Holritz | 292/175 |
| 2,878,389 | A | | 3/1959 | Raffman | 292/175 |
| 3,266,830 | A | * | 8/1966 | Appleberry | 292/128 |
| 3,632,007 | A | | 1/1972 | Kantor | 217/57 |
| 3,671,065 | A | | 6/1972 | Bingham | 292/175 |
| 3,841,674 | A | | 10/1974 | Bisbing et al. | 292/175 |
| 3,850,464 | A | * | 11/1974 | Bisbing et al. | 292/175 |
| 4,320,834 | A | * | 3/1982 | Tamaki | 206/404 |
| 4,470,624 | A | * | 9/1984 | Bisbing | 292/169 |
| 4,669,765 | A | | 6/1987 | Ullman | 292/153 |
| 4,790,579 | A | | 12/1988 | Maxwell et al. | 292/175 |
| 4,791,756 | A | * | 12/1988 | Simpson | 49/175 |
| 4,923,233 | A | * | 5/1990 | Daily | 292/332 |
| 4,940,140 | A | * | 7/1990 | Posso | 206/405 |
| 4,961,602 | A | * | 10/1990 | Pettersson | 292/98 |
| 4,995,649 | A | * | 2/1991 | Magnusson | 292/175 |
| 5,147,099 | A | | 9/1992 | McLinden | 292/175 |
| 5,158,329 | A | | 10/1992 | Schlack | 292/87 |
| 5,193,707 | A | * | 3/1993 | Mizumura | 220/326 |
| 5,231,948 | A | * | 8/1993 | Malmanger et al. | 114/201 R |
| 5,358,291 | A | | 10/1994 | Malmanger et al. | 292/175 |
| 5,628,534 | A | | 5/1997 | Morgan | 292/128 |
| 5,671,958 | A | | 9/1997 | Szapucki et al. | 292/175 |
| 5,897,147 | A | * | 4/1999 | Alyanakian et al. | 292/175 |
| 5,934,716 | A | | 8/1999 | Koveal et al. | 292/175 |
| 5,974,842 | A | * | 11/1999 | Schlack et al. | 70/208 |
| 6,050,618 | A | | 4/2000 | Tieu | 292/175 |
| 6,152,498 | A | * | 11/2000 | Lindqvist | 292/53 |

FOREIGN PATENT DOCUMENTS

| | | | |
|---|---|---|---|
| GB | 330711 | * | 6/1930 |

* cited by examiner

*Primary Examiner*—Brian E. Glessner
*Assistant Examiner*—Carlos Lugo
(74) *Attorney, Agent, or Firm*—Paul & Paul

(57) ABSTRACT

A sliding-action slam latch includes an integrally molded actuator having a rigid portion and an flexible portion, the flexible portion serving to bias the actuator closed. Pins extending from the rigid portion of the actuator contact guide surfaces on the latch body to limit travel of the actuator.

10 Claims, 3 Drawing Sheets

SLIDE LATCH

CROSS-REFERENCE TO RELATED APPLICATIONS

This application is a continuation of U.S. patent application Ser. No. 09/619,510, filed Jul. 19, 2000, now abandon which is a non-provisional application of U.S. Provisional Application No. 60/144,801, filed Jul. 21, 1999.

BACKGROUND OF THE INVENTION

1. Field of the Invention

The present invention relates generally to latching devices, and more particularly to systems for latching hinged doors or panels and the like.

2. Background of the Invention

Various types of latching devices for fastening doors, panels and the like are known.

Door-mounted "slam" latches employ a camming surface on the end of a sliding-bolt element that cooperates with a striker on the door frame to cause a bolt action to secure the door when it is closed against the frame. Such latches are activated to secure the door when the door is merely pushed shut or slammed. However, to open the door, operation of the latch mechanism is required to release the latch. In some slam latches, as the door is being closed, the bolt is urged against a spring force by the action of a camming surface cooperating with the striker to slide into the latch housing. Once the camming surface has passed the door frame inner surface, the spring force then urges the bolt element to engage behind the door frame, or to engage a keeper mounted on the door frame. In order to open the door, the bolt is manually operated, usually through a grip, to withdraw the bolt from engagement with the keeper.

Examples of prior art slam latches are disclosed in U.S. Pat. Nos. 3,841,674, 3,850,464, 5,482,333 and 5,628,634.

The spring force for such latches can be provided through separate spring elements, such as a torsion bar spring (FIGS. 8–9, U.S. Pat. No. 3,841,674), a torsion coil spring (FIGS. 11–13, U.S. Pat. No. 3,841,674), or a compression coil spring (FIG. 13, U.S. Pat. No. 3,841,674). Alternatively, the spring element can be integrally molded with a latch body made from an appropriate plastic or polymeric material (FIGS. 1–7, U.S. Pat. No. 3,841,674; U.S. Pat. No. 5,842,333; FIG. 6A–6E, U.S. Pat. No. 5,628,534).

Slam latches with integrally molded spring elements have a number of advantages over slam latches that use separate metal springs. First, slam latches with integrally molded spring elements tend to be less expensive because fewer parts are required to be made and assembled for each latch. Further, during manufacture metal springs may become embrittled and thus subject to breakage.

On the other hand, prior art latches with integrally molded spring elements may not have the same life expectancy as those that use separate metal springs. Elements formed from polymeric materials that are subjected to cyclic stresses, such as integrally molded spring elements in slam latches, sometimes fail at stress levels far below their yield stress, due to fatigue failure.

Prior slam latches have employed generally planar integrally molded spring elements. Examples include those shown in FIGS. 1–7 of U.S. Pat. No. 3,850,464, and FIGS. 6B–6E of U.S. Pat. No. 5,628,534. A variation is disclosed in U.S. Pat. No. 5,482,333, in which the spring member 5 includes two pairs of integrally hinged generally planar elements, molded from a suitable resin, such as polypropylene, in a relaxed configuration. In each of these designs, when the latch is operated stresses are generated primarily proximate the portion of the latch where the spring extends from the latch body.

There is a need for a simple, inexpensive slam latch having an integrally molded spring element that resists cyclic stresses and fatigue failure.

SUMMARY OF THE INVENTION

The present invention provides a latch of the sliding-action slam type for installation in an opening in a door or panel for releasably retaining the panel relative to a frame. The latch is particularly useful for securing carpeted panels, such as are found in automotive interiors.

The latch is adapted for installation in a generally rectangular opening or aperture formed in the panel near the edge of the door panel.

The latch includes a generally flat, rectangular plate which is positioned above the door panel when the latch is mounted in the opening. In a presently preferred embodiment, the plate extends beyond the edge of the panel and over the top of the frame, thereby serving to prevent inward movement of the panel beneath the frame.

The latch also includes a generally box-like latch body that extends under the plate and through the opening in the panel when the latch is mounted in the panel. The latch body forms a central well, and the well extends through a generally rectangular central opening that is formed in the plate.

The latch also comprises an actuator extending from the latch body for releasably engaging the frame. The actuator is accessible through the central well. The actuator includes a flexible portion and a rigid portion. The flexible portion comprises an integrally formed spring means for biasing the actuator forward. When the latch is operated, the actuator travels from a closed position to an open position. Pushing the actuator backward against the bias of the spring means operates the latch. The panel can then be swung or lifted open. When the actuator is released, the spring means restores the actuator to the closed position. Preferably, the actuator includes a middle section adapted for engagement by the operator. It is also preferred that the rigid portion of the actuator include a pawl for engaging the underside of the frame in the closed position. It is likewise preferred that the pawl include at least one angled surface adapted for engaging the edge of the frame so as to force the actuator backward against the spring means when the door or panel is slammed shut.

Preferably, the latch also includes camming means for controlling the travel of the actuator when the actuator is operated. The camming means preferably includes a first and a second opposed side wall of the latch body with respective first and second apertures formed therein. The camming means preferably also includes a first and second pin extending outwardly from the actuator adapted for travel within the respective first and second aperture when the latch is operated. Preferably, the latch is formed from a polymeric material resistant to cyclic loading, such as a synthetic acetal resin. This extends the duty life of the integral spring and thus the latch.

Lock tabs are formed on the outside of the sides of the latch body and are adapted to be compressed during installation of the latch. When the latch is installed by pushing the latch body into the opening in the panel, the lock tabs are first compressed by contact with the edge of the opening. Just before the bottom of the plate contacts the upper surface of the panel, the tabs spring outwardly, locking the latch in the panel. The desired positioning of the lock tabs depends on the effective thickness of the panel. For example, when the panel is carpeted, the effective thickness depends on the type and depth of the carpet pile.

DETAILED DESCRIPTION

Figure 1:
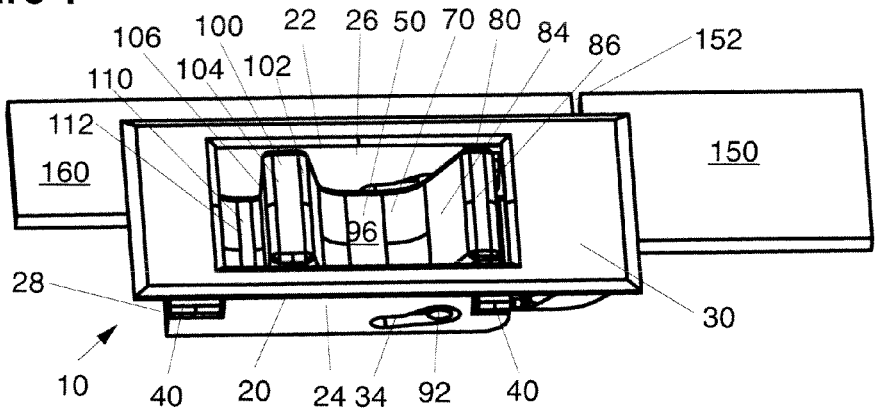
FIG. 1 is perspective view of a slide latch of the present invention, the slide latch being shown mounted in a panel and in a latch position securing the panel to a frame, the panel and frame being shown in section, the perspective being taken from above.

Referring now to the drawings in detail, wherein like reference numerals indicate like elements throughout the several views, there is shown in FIG. 1 a perspective view of a slide latch 10 of the present invention, the slide latch 10 being shown mounted in a panel or door 160, and in a closed or latched position securing the panel 160 to a frame 150, the panel 160 and frame 150 being shown in a fragmentary section thereof. The latch 10 is preferably formed as a single component by a molding process from a polymeric material having substantial resistance to fatigue from cyclic loading. A particularly preferred polymeric material is acetal resin, available as Delrin® acetal resin from E.I. du Pont de Nemours, Wilmington, Del.

The latch 10 includes a latch body 20 and a generally rectangular plate 30 from which the latch body 20 downwardly extends. A central, generally rectangular well 22 extends through the plate 30 and into the latch body 20. The latch 10 also includes an actuator 50 accessible and operable through the well 22.

Figure 2:
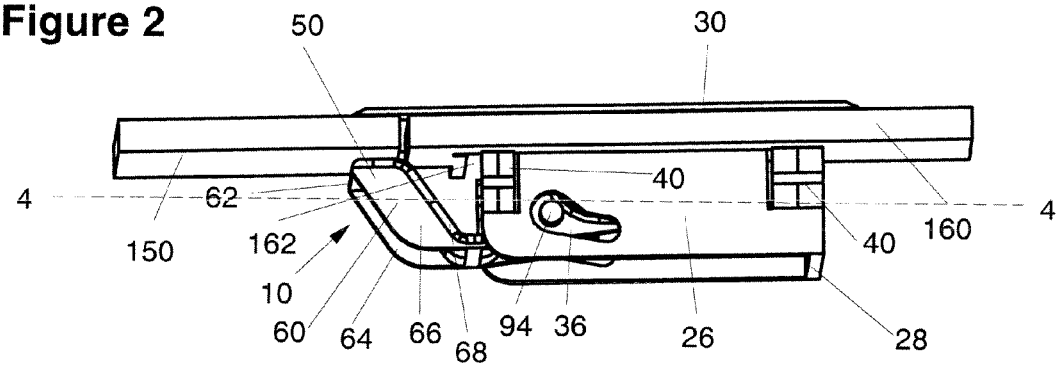
FIG. 2 is a perspective view of the slide latch of FIG. 1, the perspective being taken from below, the latch being shown in the closed position.

As shown in the side perspective view of FIG. 2, the latch body 20 includes a pair of opposed, generally planar and parallel side walls 24, 26, and a rear wall 28. As best seen in the sectional perspective view of FIG. 6, the actuator 50 is attached to the underside of the plate 30 and the side walls 26 (only one of which is visible in FIG. 6) of latch body 20 proximate the rear wall 28 of the latch body 20. However the actuator 50 is otherwise not attached to the side walls 24, 26 or the plate 30, so that the actuator 50 is free to move as described below.

The actuator 50 is in the form of a continuous folded sheet and includes a plurality of sections variously provided with side walls for functional purposes as described below.

The actuator 50 includes a front section or pawl 60 extending from the front of the latch body 20. As shown in FIG. 2, the pawl 60 contacts the underside of the frame 150 when the latch 10 is in the closed position to prevent outward rotation or travel of the panel 160 in which the latch 10 is mounted away from the frame 150. Preferably, the plate 30 of the latch 10 extends beyond the edge 152 of the frame 150 (FIG. 1) and over the frame 150 when the panel 160 is secured, so that the panel 160 extends between the underside of the plate 30 and the pawl 60. When the actuator 50 is operated to move the actuator 50 from the closed position (FIG. 2) to an open position (FIG. 3), the pawl 60 is retracted rearward and downward so that it no longer extends under and adjacent the frame 150, thus permitting the panel 160 to be opened, as shown in the side perspective view of FIG. 7.

Figure 6:
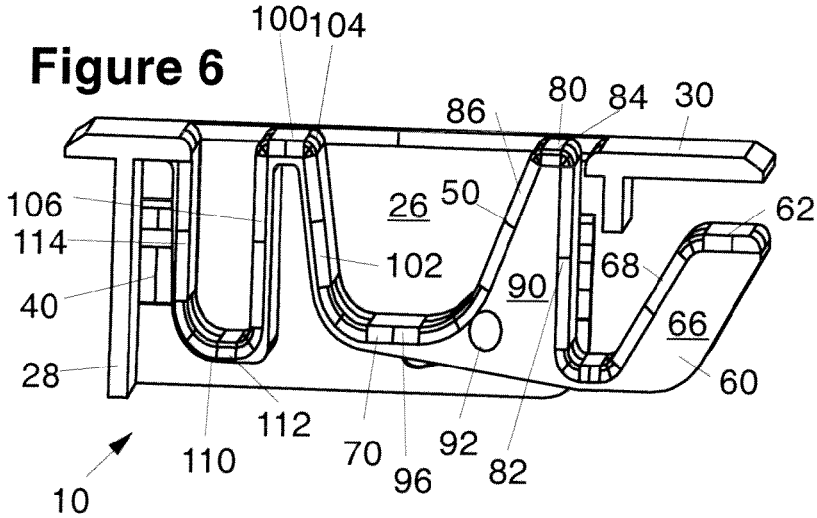
FIG. 6 is a side elevational sectional view of the slide latch of FIG. 1, the section being taken along the line 6—6 of FIG. 5.

As best seen in FIG. 6, the actuator 50 includes the pawl 60, as well as a middle section 70 extending from the rear of the pawl 60, and a rear section 110, extending from the rear of the middle section 70.

Figure 4:
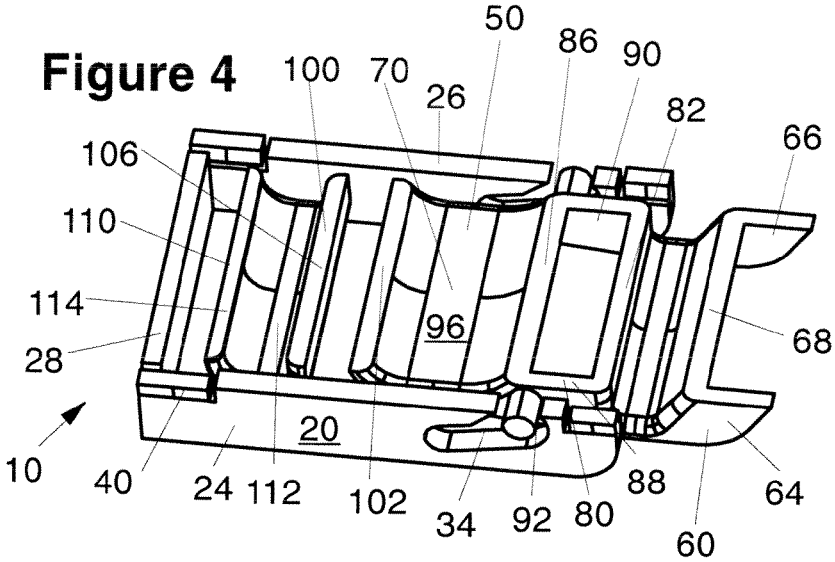
FIG. 4 is a sectional view of the slide latch of FIG. 1, the section being taken along the line 4—4 of FIG. 2.
Figure 5:
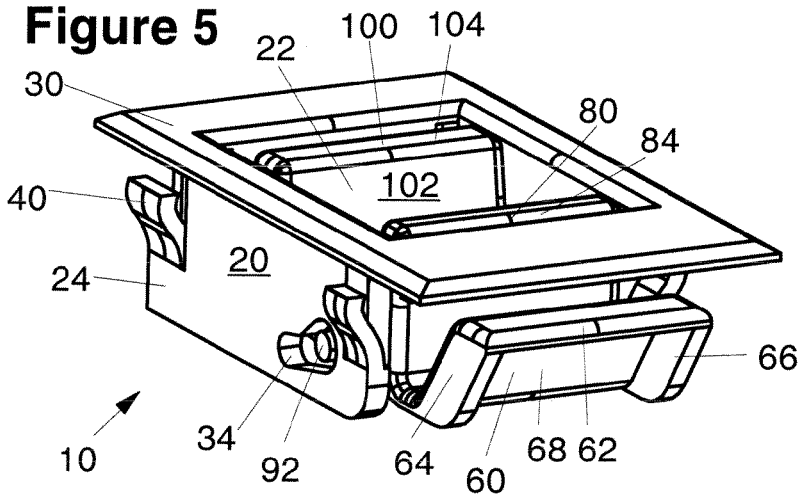
FIG. 5 is a perspective view of the slide latch of FIG. 1 as seen from above and to the front of the right side of the latch, the panel and frame being omitted to reveal the latch.

As best seen in FIGS. 4–6, the pawl 60 includes a pair of opposed, spaced, generally trapezoidal side walls 64, 66, a generally rectangular, horizontal top wall 62 extending between the side walls 64, 66 at their respective upper ends, and a generally rectangular rear wall 68 extending between the side walls 64, 66 proximate their respective rear portions and extending from the rear of the top wall 62. This construction is believed to provide a strong, rigid, lightweight structure for the pawl 60. The front surfaces of the side walls 64, 66 are sloped so that when the panel is closed or slammed shut, the side walls 64, 66 of the pawl 60,contact the edge of the frame 150, and the actuator 50 is pushed backward, thereby permitting the panel or door 160 to close.

The middle section 70 of the actuator 50 (best seen in FIGS. 1, 4 and 6), extends continuously from the front section or pawl 60. The middle section includes an upwardly extending first or forward pleat 80 having an upwardly and rearwardly sloping front wall 82 extending continuously from the rear wall 68 of the pawl 60, a top or upper section 84 positioned approximately flush with the upper surface of the plate 30, and a downwardly and rearwardly sloping rear wall 86 which terminates in a section that is approximately horizontal. The forward pleat 80 also includes a pair of opposed, spaced generally parallel side walls 88, 90 extending from and continuously formed with the respective edges of the front wall 82, top section 84, and rear wall 86, thus providing rigidity to the forward pleat 80. The pawl 60 and forward pleat 80 of the middle section 70 thus constitute two rigid portions of the actuator 50.

Extending from either side wall 88, 90 of the forward pleat 80 are a pair of generally cylindrical guide pins 92, 94 which are positioned to extend into a pair of corresponding generally teardrop-shaped apertures 34, 36 formed in the side walls 24, 26 of the latch body 20. The guide pins 92, 94 and respective apertures 34, 36 comprise camming means controlling the travel of the actuator 50 as described below.

The middle section 70 of the actuator 50 further comprises a rear pleat 100 having a front wall 102 which extends continuously rearwardly and upwardly from the rear wall 86 of the forward pleat 80, a top or upper section 104 positioned approximately flush with the upper surface of the plate 30, and a downwardly and slightly rearwardly sloping rear wall 106.

The rear wall 86 of the forward pleat 80 and the front wall 102 of the rear pleat 100 together form a concavity 96 shaped to receive the finger of an operator.

The actuator 50 also includes a rear section 110 comprising a generally flat and rearwardly extending bottom wall 112 extending continuously from the bottom of the rear wall 106 of the rear pleat 100, and an upwardly extending rear wall 114 extending from the back of the bottom wall 112 up to the underside of the plate 30 proximate the rear edge of the well 22.

The rear pleat 100 and rear section 110 together comprise a flexible spring means for biasing the actuator 50 and pawl 60 forward.

Figure 3:
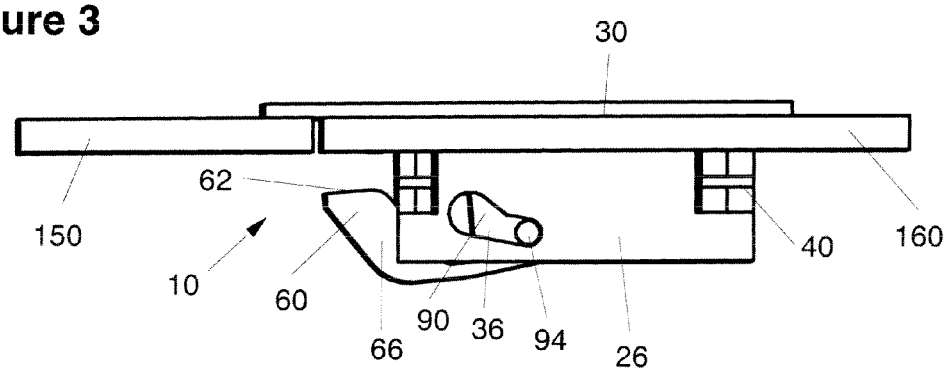
FIG. 3 is a side elevational view of the slide latch of FIG. 1, the latch being shown in the open position.
Figure 7:
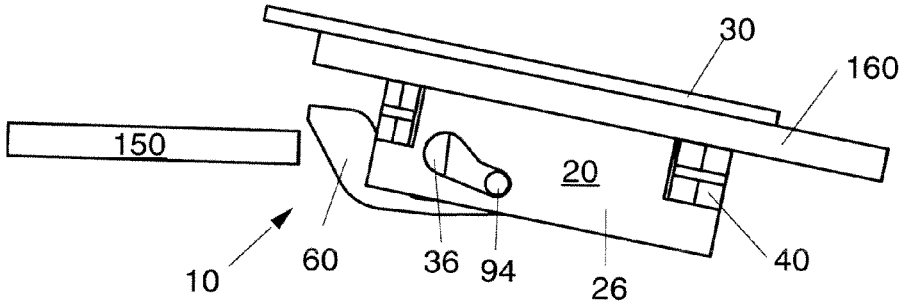
FIG. 7 is a side elevational view of the slide latch of FIG. 1, showing the latch in the open position and the panel being opened.
Figure 8:
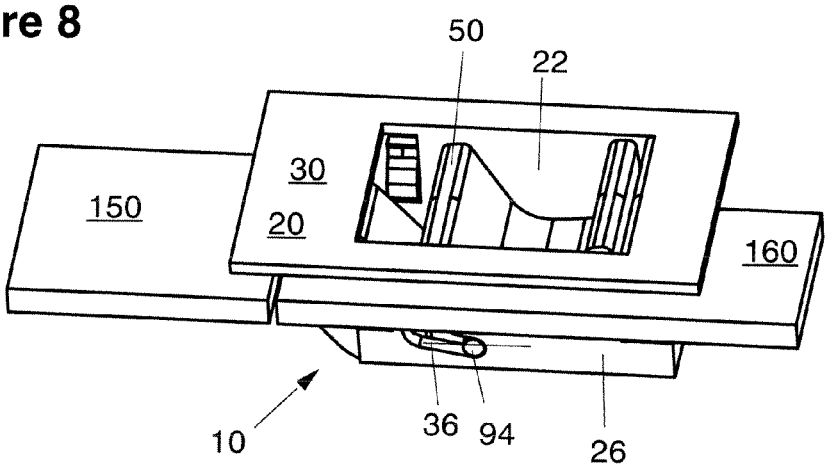
FIG. 8 is a perspective view of the slide latch of FIG. 1 showing the slide latch being mounted in the panel opening.
Figure 9:
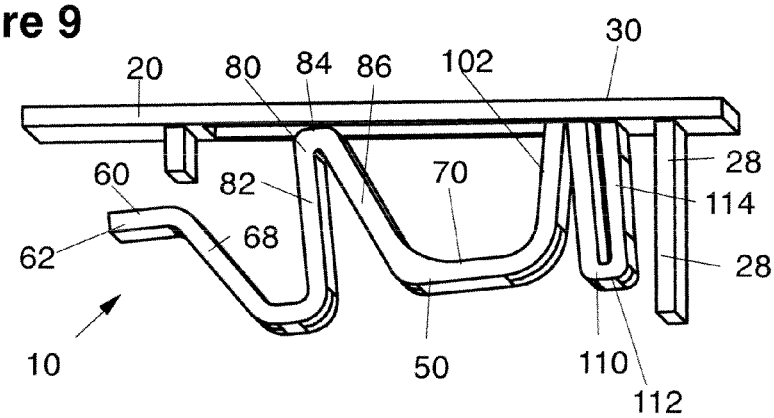
FIG. 9 is a side elevational sectional view of the slide latch of FIG. 1, the slide latch being shown in an open position with the spring means compressed and the front portion of the slide latch being disengaged from the frame so that the panel can be opened, the slide latch being sectioned to emphasize the operation of the actuator.

As best seen in FIGS. 2 and 6, in the relaxed or normal configuration the pawl 60 is positioned so that the top wall 62 of the pawl 60 and the underside of the forward end of the plate 30 are generally parallel and spaced from one another by slightly more than the thickness of the frame 150, thereby securing the panel 160 in a closed and locked position. To operate the latch 10 to open the panel 160 the operator places a finger in the concavity 96 and pushes downwardly and rearwardly against the front wall 102 of the rear pleat 100. The travel of the rigid forward portion of the actuator 50, namely the front pleat 80 and the pawl 50 is limited and defined by the camming action of the pins 92, 94 pressing against the respective edges of the apertures 34, 36 formed in the side walls 24, 26 of the latch body 20. Simultaneously, the flexible rear portion of the actuator 50, namely the rear pleat 100 and the rear section 110 are compressed, as best seen in FIG. 9. When the rigid forward portion of the actuator 50 has reached the ultimate limit of its rearward travel, such as depicted in FIG. 3, the pawl 60 extends no further forward than the edge 164 of the panel 160, thereby permitting the operator to pull the panel open, such as depicted in FIG. 7. When the operator removes her finger from the concavity 96, the spring means forces the rigid forward section of the actuator 50 forward. To close and lock the panel 160, the operator can again manually retract the actuator 50 and push the panel 160 closed, or, in the alternative, can simply slam the panel 160 shut. When the pawl encounters the edge 162 of the door frame 150 as the panel is being shut, the contact by the outer edges of the side walls 64, 66 of the pawl 60 with the edge 152 of the frame 150 forces the rigid portion of the actuator 50 backward against the spring means. When the pawl 60 passes below the underside of the frame 150, the spring means forces the rigid portion of the actuator 50 forward to position the pawl 60 once again below the frame 150.

As best seen in the perspective views of FIGS. 2 and 5, the latch body 20 includes a plurality of lock tabs 40 formed in the side walls 24, 26. A generally rectangular aperture 162 (FIG. 2) is formed in the panel 160 proximate the edge thereof for mounting the latch 10 of the present invention. The latch 10 is installed by placing the pawl 60 under the forward edge of the mounting aperture 162 and pressing down. As the latch 10 is pressed down, the lock tabs 40 are initially pressed inwardly by the edge of the mounting aperture 162, and finally snap outwardly to lock the latch 10 in the mounting aperture 162.

The latch of the present invention may be adapted to be engaged by the operator in a different manner. For example, instead of a well formed in the latch body, the latch can include a post or button extending up above the upper surface of the flange to be grasped by the operator (not shown).

Various other modifications can be made in the details of the various embodiments of the apparatus of the present invention, all within the scope and spirit of the invention and defined by the appended claims.

What is claimed is:

1. A latch of the sliding-action slam type for installation in an opening in a door panel for releasably retaining the door panel relative to a frame, the latch being moveable between a closed position and an open position when installed in the opening in the door panel, the latch comprising a) a plate, the plate being positioned above the door panel when the latch is mounted in the opening;

b) a latch body extending under the plate and through the opening in the panel when the latch is mounted in the panel, the latch body forming a central well, the well extending through the plate, the latch body including a first and a second opposed side wall, the first and second side wall having a respective first and second aperture formed therein, and c) an actuator extending from the latch body for releasably engaging the frame, the actuator being accessible through the central well, the actuator including an integrally formed spring means for biasing the actuator, the actuator travelling from a closed to an open position when the latch is operated against the bias of the spring means; the actuator having a first and second pin extending outwardly therefrom for travel within the respective first and second aperture when the latch is operated;

wherein the apertures and pins comprising camming means controlling the travel of the actuator when the latch is operated.

2. A latch according to claim 1 wherein the plate extends beyond the edge of the door and over the frame when the latch is mounted in the opening and the door is closed, the latch preventing inward travel of the door through the frame.

3. A latch according to claim 1 wherein the actuator comprises a pawl for engaging the underside of the frame in the closed position.

4. A latch according to claim 3 wherein the pawl includes at least one angled surface for engaging the edge of the frame so that the actuator is pushed back against the spring bias when the panel is slammed shut.

5. A latch according to claim 1 wherein the actuator includes a rear section extending from the back of the latch, a middle section adapted for movement by an operator, the middle section extending from the rear section, and a pawl for engaging the underside of the frame in the closed position, the pawl extending from the middle section.

6. A latch according to claim 5 wherein the actuator has the form of a continuous folded sheet.

7. A latch according to claim 6 wherein the middle section comprises a rear pleat and a forward pleat, the rear pleat and the forward pleat each comprising a pair of generally planar walls extending downwardly from a respective top portion, each respective top portion being positioned in the plane of the plate when the actuator is in the closed position.

8. A latch according to claim 7 wherein the rear pleat is flexible and the forward pleat is rigid.

9. A latch according to claim 8 wherein the spring means comprises the rear pleat and the rear section.

10. A latch according to claim 1 wherein the latch is formed from a polymeric material resistant to cyclic loading.

* * * * *